US010113800B2

(12) United States Patent
Li et al.

(10) Patent No.: US 10,113,800 B2
(45) Date of Patent: Oct. 30, 2018

(54) LANCE

(71) Applicant: CHINA ENFI ENGINEERING CORPORATION, Beijing (CN)

(72) Inventors: Dong Li, Beijing (CN); Zhenmin Zhang, Beijing (CN); Liqiong Hu, Beijing (CN); Kefei Cao, Beijing (CN); Xiaohong Hao, Beijing (CN)

(73) Assignee: CHINA ENFI ENGINEERING CORPORATION, Beijing (CN)

( * ) Notice: Subject to any disclaimer, the term of this patent is extended or adjusted under 35 U.S.C. 154(b) by 147 days.

(21) Appl. No.: 15/285,019

(22) Filed: Oct. 4, 2016

(65) Prior Publication Data

US 2018/0094857 A1 Apr. 5, 2018

(51) Int. Cl.
*F27D 3/18* (2006.01)
*F27D 3/16* (2006.01)

(52) U.S. Cl.
CPC ..... *F27D 3/18* (2013.01); *F27D 3/16* (2013.01); *F27D 2003/169* (2013.01)

(58) Field of Classification Search
CPC ..... F27D 2003/169; F27D 3/16; F27D 3/18
USPC ..... 266/47, 225, 265, 268
See application file for complete search history.

(56) References Cited

U.S. PATENT DOCUMENTS 3,321,139 A * 5/1967 De Saint Martin ... C21C 5/4606 239/132.3
6,673,305 B2 * 1/2004 Dunne ..... C21C 5/4606 266/225
8,919,670 B2 * 12/2014 Shivaram ..... C21C 5/4606 239/403
9,829,250 B2 * 11/2017 Matusewicz ..... C21C 5/4613
2016/0153715 A1 * 6/2016 Pilote ..... C21B 7/24 75/707

* cited by examiner

*Primary Examiner* — Scott R Kastler
*Assistant Examiner* — Michael Aboagye
(74) *Attorney, Agent, or Firm* — Osha Liang LLP

(57) ABSTRACT

A lance including: a central pipe having a wear-resistant ceramic layer coated on an inner wall thereof; a central casing pipe having a casing pipe groove in an outer wall thereof, in which the central casing pipe is fitted over the central pipe; an intermediate pipe fitted over the central casing pipe, in which a combustion-supporting gas chamber is formed between a front part of the central pipe and the intermediate pipe, and an intermediate pipe groove is formed in an outer wall of the rear part; and an outer casing pipe fitted over the intermediate pipe, in which a cooling medium chamber is formed between a front part of the intermediate pipe and the outer casing pipe, and a cooling medium injection channel is defined by an inner wall of the outer casing pipe and the intermediate pipe groove.

9 Claims, 2 Drawing Sheets

LANCE

FIELD

The invention refers to a lance, particularly to a lance for a metallurgical furnace.

BACKGROUND

A lot of metallurgical technologies are developed in recent years with the development of metallurgical industry and the requirements for environmental protection and energy conservation. In the field of nonferrous metallurgy, metallurgical technologies such as side blowing or bottom blowing are widely used, and a lance has been the essential device used in metallurgy, for example, a side blowing lance used in phosphorus extracting with thermal process and a bottom blowing lance used in lead smelting of bottom blowing.

A central pipe of a traditional side or bottom blowing lance is used as a fuel channel for injecting fuel such as pulverized coal or heavy oil, which is very easy to wear.

SUMMARY

The present invention aims to solve at least one of the existing technical questions among the current technology. Therefore, one objective of the present invention is to put forward a lance with low processing and maintenance costs.

The lance according to an embodiment of the present invention, including: a central pipe provided with a wear-resistant ceramic layer on an inner wall thereof; a central casing pipe fitted over the central pipe and having a casing pipe groove formed in an outer wall of the central pipe, in which a rear end of the central casing pipe is flush with a rear end of the central pipe, and a length of the central casing pipe is less than a length of the central pipe; an intermediate pipe fitted over the central casing pipe, in which a rear end of the intermediate pipe is flush with the rear end of the central casing pipe, a combustion-supporting gas chamber is formed between a front part of central pipe and the intermediate pipe, the central casing pipe is fitted with the intermediate pipe, so as to define a combustion-supporting gas injection channel between an inner wall of the intermediate pipe and the casing pipe groove, an external diameter of a rear part of the intermediate pipe is greater than that of a front part of the intermediate pipe, and an intermediate pipe groove is formed in an outer wall of the rear part; and an outer casing pipe fitted over the intermediate pipe, in which a cooling medium chamber is formed between the front part of the intermediate pipe and the outer casing pipe, and the rear part of the intermediate pipe is fitted with the outer casing pipe to define a cooling medium injection channel between an inner wall of the outer casing pipe and the intermediate pipe groove.

The lance according to the embodiment of the present invention has a prolonged service life, because wear and tear caused by injection of the pulverized coal is reduced by providing the wear-resistant ceramic layer on the inner wall of the central pipe, which means a replacement cycle is prolonged. In addition, since the central casing pipe is disposed on the outside of the central pipe, and the casing pipe groove for injecting combustion-supporting gas is formed in the outer wall of the central casing pipe, there is no need to provide a groove for injecting the combustion-supporting gas in each replaced central pipe, which reduces a processing cost of the central pipe, and the central casing pipe can be reused with respect to the central pipe, thus reducing a processing cost and a maintenance cost of the whole lance. Furthermore, since a length of the central casing pipe is less than the length of the central pipe, a lager combustion-supporting gas chamber can be formed between the front part of the central pipe and the front part of the intermediate pipe, thus greatly reducing resistance to gas, energy consumption and costs.

In addition, the lance provided by the present invention also has the following technical features:

The lance further includes: a cooling medium joint having a cooling medium inlet passage communicating with the cooling medium chamber; a combustion-supporting gas joint connected with the cooling medium joint and having a combustion-supporting gas inlet passage communicating with the combustion-supporting gas chamber; and a fuel pipe base connected with the combustion-supporting gas joint and having a central hole communicating with a central hole of the central pipe.

A cooling medium, the combustion-supporting gas, and a fuel can be conveniently fed to the lance from a cooling medium source, a combustion-supporting gas source and a fuel source to be injected into a smelting furnace, such as a reduction oxidation furnace of phosphorus extracting with thermal method through the cooling medium joint, the combustion-supporting gas joint, the fuel pipe base, and corresponding inlet passages communicating with corresponding passages formed therebetween.

The lance further includes a cooling medium nozzle installed in the cooling medium joint and defining a cooling medium mixing chamber together with the cooling medium joint, in which a first and second cooling medium inlet passages communicate with the cooling medium chamber through the cooling medium mixing chamber.

The cooling medium nozzle can defines a cooling medium mixing chamber together with cooling medium joint, and gaseous and liquid cooling mediums can be fully mixed in the cooling medium mixing chamber to be supplied into the cooling medium chamber to increase a cooling effect.

The central pipe, the central casing pipe, the intermediate pipe and the outer casing pipe are successively coaxially fitted over the former.

A plurality of the casing pipe grooves and a plurality of the intermediate pipe grooves are provided.

Both the plurality of the casing pipe grooves and the plurality of the intermediate pipe grooves are configured to be spiral grooves or straight grooves parallel to an axial direction of the central casing pipe.

The plurality of the casing pipe grooves is uniformly arranged in a surface of a rear part of the central casing pipe, and the plurality of the intermediate pipe grooves is uniformly arranged in a surface of the rear part of the intermediate pipe.

As the plurality of the casing pipe grooves and the plurality of the intermediate pipe grooves are uniformly distributed in the rear end of the lance, the cooling medium and the combustion-supporting gas can be uniformly injected into the smelting furnace with a better smelting effect.

Both the casing pipe groove and the intermediate pipe groove have rectangular or triangular cross sections.

The central pipe, the central casing pipe, the intermediate pipe and the outer casing pipe are configured to be stainless steel pipes.

As to the lance according to an embodiment of the present invention, the central pipe is hard to wear by providing the wear-resistant ceramic layer on the inner wall of the central pipe which is used for supplying the pulverized coal. The central pipe can be pulled out from the central casing pipe and replaced by a new one though the central pipe is worn, and other elements can be reused and the groove in the central pipe used for injecting oxygen is needless, so the processing is simple costs are low, and the maintenance fee can be reduced.

Additional aspects and advantages of the present invention will be given in part in the following descriptions, become apparent in part from the following descriptions, or be learned from the practice of the embodiments of the present disclosure.

BRIEF DESCRIPTION OF THE DRAWINGS

The above and/or additional aspects and advantages of the present invention will become apparent and more readily appreciated from the following descriptions made with reference to the drawings, in which.

DETAILED DESCRIPTION

Figure 1:
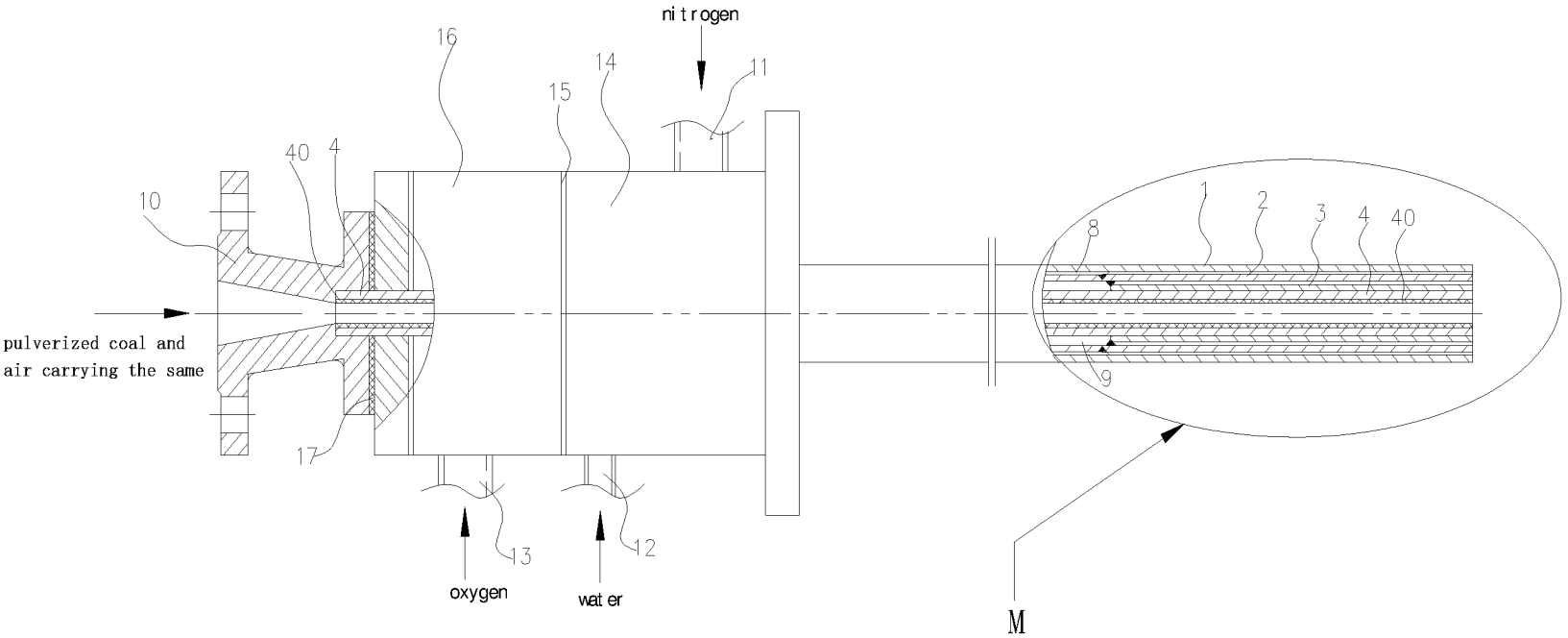
FIG. 1 is a longitudinal sectional schematic view of a lance according to an embodiment of the present invention.

Reference will be made in detail to embodiments of the present invention. The embodiments are shown in the drawings. The same or similar elements and the elements having same or similar functions are denoted by like reference numerals throughout the descriptions. The embodiments described herein with reference to drawings are explanatory, illustrative, and used to generally understand the present invention. The embodiments shall not be construed to limit the present invention.

In the description of the invention, the terms of "longitudinal", "horizontal", "front", "rear", "left", "right", "inner", "outer" and other indicated orientations or positional relations are based on the orientations or positional relations shown in attached drawings, which are just convenient for describing the present invention and simplifying description, but not mean or hint that the indicated device or element must have the specific orientation, or specific structure and operation of orientation, thus it shall not be understood as a restriction of the present invention. In addition, terms of "first" and "second" are just used for describing the purpose, but shall not be understood to mean or hint relative importance.

It should be noted that the terms of "install", "connect together" and "connection" shall be generally understood unless otherwise clearly specified and limited, and may be, for example, fixed connections, detachable connections or integral connections; may also be mechanical or electrical connections; may also be direct connections, or indirect connections by intermediation; and may also be inner communications of two elements, which can be understood by those skilled in the art according to specific situations. In addition, unless otherwise stated, "a plurality of" in the present invention means two or more than two.

Figure 2:
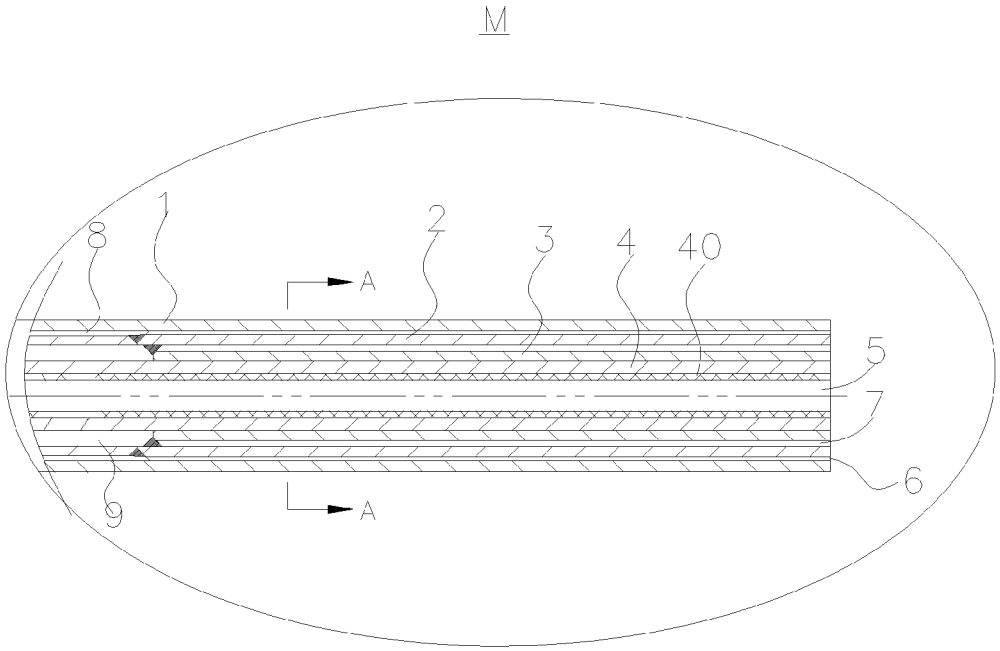
FIG. 2 is an enlarged view of part M circled in FIG. 1.
Figure 3:
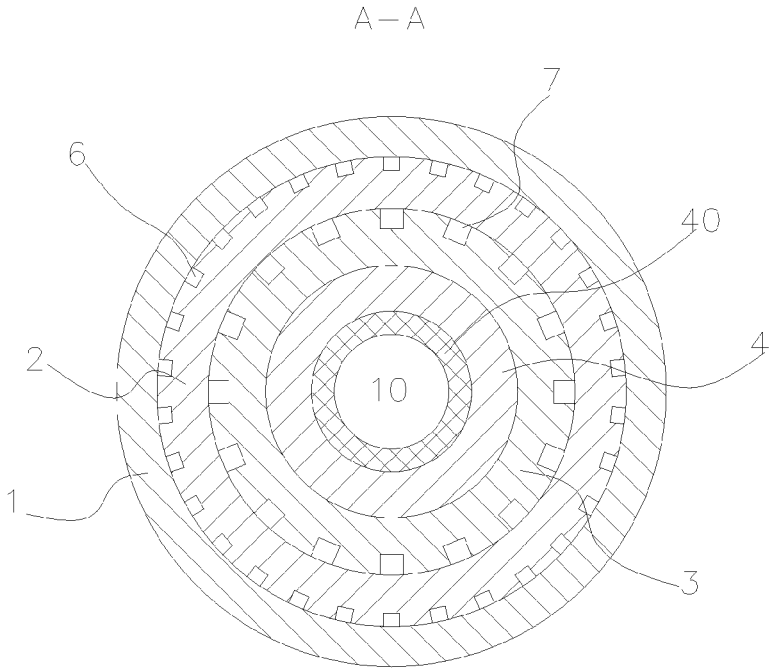
FIG. 3 is a sectional view taken along line A-A in FIG. 2.

Referring to FIG. 1-FIG. 3, a lance according to embodiments of the present invention will be described in the following. The lance described in the following is used for a continuous reduction furnace of lead slag, pulverized coal (transported by air) is adopted as a fuel, oxygen is adopted as the combustion-supporting gas, and nitrogen (or air) and/or water is adopted as a cooling medium, and the example of the lance is for convenience of description of the present invention and shall not be construed to limit the present invention.

As shown in FIG. 1-FIG. 2, the lance according to the embodiment of the present invention includes: a central pipe 4, a central casing pipe 3, an intermediate pipe 2 and an outer casing pipe 1. The above four pipes are successively fitted over the former to constitute a casing pipe structure. Optionally, the central pipe 4, the central casing pipe 3, the intermediate pipe 2 and the outer casing pipe 1 are successively coaxially fitted over the former.

A wear-resistant ceramic layer 40 is coated on an inner wall of the central pipe 4, and a fuel injection channel is formed in a central hole 5 of the central pipe 4, which is used to inject the pulverized coal into the continuous reduction furnace of lead slag by air.

The central casing pipe 3 is movably fitted over the central pipe 4, for example, a clearance fit is provided between the central casing pipe 3 and the central pipe 4, and a clearance may be quite small, by which the central pipe 4 can be conveniently pulled out from the central casing pipe 3. A length of the central casing pipe 3 is less than that of the central pipe 4, and a rear end of the central casing pipe 3 (such as a right end of the central casing pipe 3 in FIG. 1) is flush with a rear end of the central pipe 4 (such as a right end of the central pipe 4 in FIG. 1). A casing pipe groove 7 axially throughout a rear part is formed in an outer wall of the central casing pipe 3. A length of the casing pipe groove 7 can be determined by specific applications, and that is a length of an intermediate pipe groove 6 can be determined by the specific applications.

The intermediate pipe 2 is fitted over the central casing pipe 3, and a rear end of the intermediate pipe 2 is flush with a rear end of the central casing pipe 3. An annular chamber which is between a front part of the central pipe 4 and the intermediate pipe 2 is configured to be a combustion-supporting gas chamber 9. The central casing pipe 3 fits with the intermediate pipe 2, so that an inner wall of the intermediate pipe 2 and the casing pipe groove 7 define a combustion-supporting gas injection channel. In other words, between the central casing pipe 3 and the intermediate pipe 2, oxygen is mainly injected out through the casing pipe groove 7, for example, a clearance fit with a quite small clearance may be provided between the central casing pipe 3 and the intermediate pipe 2. In other words, it also can be understood that the inner wall of the intermediate pipe 2 defines the casing pipe groove 7 as the combustion-supporting gas infection channel. If the clearance between the inner wall of the intermediate pipe 2 and the outer wall of the central casing pipe 3 is excessive, the oxygen can also be sent into the continuous reduction furnace of lead slag through the above clearance, and will not be injected out through the casing pipe groove 7, which means a poor injection, i.e. the effect of spray will be decreased, and the spray action of casing pipe groove 7 will be reduced or invalid.

An external diameter of a rear part of the intermediate pipe 2 is greater than that of a front part of the intermediate pipe 2, and the intermediate pipe groove 6 axially throughout the rear part is formed in the outer wall of the rear part.

The terms of "front" and "rear" are convenient for description herein. A side (the right side of FIG. 1) of the lance which is inserted into the continuous reduction furnace of lead slag is defined as the rear part, and the opposite side (the left side of FIG. 1) is defined as the front part. For example, as for the intermediate pipe 2, a length of the front part, i.e. the length of a part where the intermediate pipe groove 6 is formed, and a length of the rear part, i. e. the length of a part has no intermediate pipe groove 6 can be determined and divided as needed. In other words, a length of the intermediate pipe groove 6 can be determined according to specific applications.

The outer casing pipe 1 is fitted over the intermediate pipe 2, so that a cooling medium chamber 8 is formed between the front part of the intermediate pipe 2 and the outer casing pipe 1, and the rear part of the intermediate pipe 2 is fitted with the outer casing pipe 1, so that a cooling medium injection channel can be defined by an inner wall of the outer casing pipe 1 and the intermediate pipe groove 6. In other words, between the rear part of the intermediate pipe 2 and the outer casing pipe 1, the cooling medium is mainly injected through the intermediate pipe groove 6, for example, a clearance fit with a quite small clearance may be provided between the rear part of intermediate pipe 2 and the outer casing pipe 1. In other words, it also can be understood that the inner wall of the outer casing pipe 1 defines the intermediate pipe groove 6 as the cooling medium injection channel. If the clearance between the inner wall of the outer casing pipe 1 and an outer wall of intermediate pipe 2 is excessive, the cooling medium can also be sent into the continuous reduction furnace of lead slag through the above clearance, and will not be mainly injected out through the intermediate pipe groove 6, which means a poor injection, i.e. the intermediate pipe groove 6 will inject less the cooling medium or cannot inject the cooling medium.

The lance according to the embodiment of the present invention has a prolonged service life, because wear and tear caused by injection of the pulverized coal is reduced by providing the wear-resistant ceramic layer 40 on the inner wall of the central pipe 4, which means a replacement cycle is prolonged. In addition, since the central casing pipe 3 is disposed on the outside of the central pipe 4, and the casing pipe groove 7 for injecting the combustion-supporting gas is formed in the outer wall of the central casing pipe 3, there is no need to provide a groove for injecting the combustion-supporting gas in each replaced central pipe 4, which reduces a processing cost of the central pipe 4, and the central casing pipe 3 can be reused with respect to the central pipe 4, thus reducing a processing cost and a maintenance cost of the whole lance. Furthermore, since a length of the central casing pipe 3 is less than a length of the central pipe 4, a lager combustion-supporting gas chamber can be formed between the front part of the central pipe 4 and the front part of the intermediate pipe 2, thus greatly reducing resistance to gas, energy consumption and the costs.

In a specific example of the present invention, as shown in FIG. 3, a plurality of casing pipe grooves 7 is provided and configured to be straight grooves parallel to an axial direction of the central casing pipe 3. Certainly, the plurality of casing pipe grooves 7 may also configured to be spiral grooves formed around an axis of the central casing pipe 3.

To make injection of the combustion-supporting gas more evenly and improve the smelting effect, the plurality of casing pipe grooves 7 is uniformly arranged in the surface of the rear part (the surface of the rear part inserted into a furnace) of the central casing pipe 3, as shown in FIG. 3. In further examples, each casing pipe groove 7 has a rectangular cross section to enlarge an injecting area, or a triangular cross section.

In another specific example of the present invention, as shown in FIG. 3, a plurality of intermediate pipe grooves 6 is provided and configured to be straight grooves parallel to an axial direction of the intermediate pipe 2, certainly, the plurality of intermediate pipe groove 6 may also configured to be the spiral grooves.

To make injection of a mixture of nitrogen and water more evenly and improve the smelting effect, the plurality of intermediate pipe grooves 6 is uniformly arranged in the surface of the rear part of the intermediate pipe 2, as shown in FIG. 3. In further examples, each intermediate pipe groove 6 has a rectangular cross section to enlarge an injecting area, or a triangular cross section.

In an example of the present invention, the central pipe 4, the central casing pipe 3, the intermediate pipe 2 and the outer casing pipe 1 are all configured to be stainless steel pipes.

A lance according to a further embodiment of the present invention further includes a cooling medium joint 14, a combustion-supporting gas joint 16 and a fuel pipe base 10.

The cooling medium joint 14 has a cooling medium inlet passage which communicates with the cooling medium chamber 8. In an example of the present invention, the cooling medium inlet passage includes a first cooling medium inlet passage 11 and a second cooling medium inlet passage 12 which are formed by cooling medium inlet pipes. The first cooling medium inlet passage 11 is connected with a nitrogen or air source (not shown in the drawings) to supply nitrogen or air, and the second cooling medium inlet passage 12 is connected with a water source (not shown) to supply cooling water, thus further improving a cooling effect on the lance.

In further examples of the present invention, the lance includes a cooling medium nozzle (not shown in the drawings), the cooling medium nozzle is installed in the cooling medium joint 14 and defines a cooling medium mixing chamber (not shown in the drawings) together with the cooling medium joint 14, the first and second cooling medium inlet passages 11 and 12 communicate with the cooling medium chamber 8 through the cooling medium mixing chamber. Nitrogen and water can enter the cooling medium chamber 8 after being mixed uniformly in the cooling medium mixing chamber, and then injected into the continuous reduction furnace of lead slag through a cooling medium injection channel of defined by the intermediate pipe groove 6 and the inner wall of the outer casing pipe 1, so that the cooling effect and uniformity of injection can be improved, thereby improving the smelting effect.

The combustion-supporting gas joint 16 is connected with the cooling medium joint 14, as shown in FIG. 1, a first sealing gasket 15 is disposed therebetween to increase the sealing property. The combustion-supporting gas joint 16 has a combustion-supporting gas inlet passage 13 which communicates with the combustion-supporting gas chamber 9, more specifically, the combustion-supporting gas inlet passage 13 is formed by a combustion-supporting gas inlet pipe.

As shown in FIG. 1, the fuel pipe base 10 is connected with the combustion-supporting gas joint 16 and has a fuel inlet channel which communicates with the central hole 5 of the central pipe 4, and a second sealing gasket 17 is disposed therebetween to increase the sealing property.

Referring to FIG. 1-FIG. 3, operation of the lance according to the embodiments of the present invention will be described in the following.

The pulverized coal is fed into the central pipe 4 by air after passing the fuel pipe base 10, and then is injected into the continuous reduction furnace of lead slag from a rear end of the central pipe 4. Meanwhile, oxygen is fed into the combustion-supporting gas chamber 9 through the combustion-supporting gas inlet passage 13, and then injected into the continuous reduction furnace of lead slag from the rear end through the combustion-supporting gas injection channel (i.e. the casing pipe groove 7 in the central casing pipe 3), in which part of injected oxygen reacts with the pulverized coal to provide heat for smelting, and other part of oxygen is used as a reductant. Moreover, nitrogen or air is supplied into the cooling medium chamber through the first cooling medium inlet passage 11, water is supplied into the cooling medium through the second cooling medium inlet passage 12, and nitrogen and water enter the cooling medium room 8 after being mixed in the cooling medium chamber, and then are supplied to the cooling medium injection channel (i. e. the intermediate pipe groove 6) to be injected into the continuous reduction furnace of lead slag from the rear end, so that the lance can be cooled.

The central pipe 4 is hard to wear by providing the wear-resistant ceramic layer 40 on the inner wall of the central pipe 4 which is used for supplying the pulverized coal. The central pipe 4 can be pulled out from the central casing pipe 3 and replaced by a new one though the central pipe 4 is worn, and other elements can be reused and the groove in the central pipe 4 used for injecting oxygen is needless, so the processing is simple, costs are low, and the maintenance fee can be reduced.

Reference throughout this specification to "an embodiment," "some embodiments," "explanatory embodiment", "an example," "a specific example," or "some examples," means that a particular feature, structure, material, or characteristic described in connection with the embodiment or example is included in at least one embodiment or example of the present disclosure. Thus, the appearances of the terms in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure, and the scope of the present invention is defined by claims and equivalents thereof.

What is claimed is:

1. A lance, comprising:

a central pipe provided with a wear-resistant ceramic layer on an inner wall thereof;

a central casing pipe fitted over the central pipe and having a casing pipe groove formed in an outer wall of the central casing pipe, wherein a rear end of the central casing pipe is flush with a rear end of the central pipe, and a length of the central casing pipe is less than a length of the central pipe;

an intermediate pipe fitted over the central casing pipe, wherein a rear end of the intermediate pipe is flush with the rear end of the central casing pipe, a combustion-supporting gas chamber is formed between a front part of the central pipe and the intermediate pipe, the central casing pipe is fitted with the intermediate pipe, so as to define a combustion-supporting gas injection channel between an inner wall of the intermediate pipe and the casing pipe groove, an external diameter of a rear part of the intermediate pipe is greater than that of a front part of the intermediate pipe, and an intermediate pipe groove is formed in an outer wall of the rear part; and an outer casing pipe fitted over the intermediate pipe, wherein a cooling medium chamber is formed between the front part of the intermediate pipe and the outer casing pipe, and the rear part of the intermediate pipe is fitted with the outer casing pipe to define a cooling medium injection channel between an inner wall of the outer casing pipe and the intermediate pipe groove.

2. The lance according to claim 1, further comprising:

a cooling medium joint having a cooling medium inlet passage communicating with the cooling medium chamber;

a combustion-supporting gas joint connected with the cooling medium joint and having a combustion-supporting gas inlet passage communicating with the combustion-supporting gas chamber; and a fuel pipe base connected with the combustion-supporting gas joint and having a central hole communicating with a central hole of the central pipe.

3. The lance according to claim 2, further comprising: a cooling medium nozzle installed in the cooling medium joint and defining a cooling medium mixing chamber together with the cooling medium joint, wherein a first cooling medium inlet passage and a second cooling medium inlet passage communicate with the cooling medium chamber through the cooling medium mixing chamber.

4. The lance according to claim 1, wherein the central pipe, the central casing pipe, the intermediate pipe and the outer casing pipe are successively coaxially fitted over the former.

5. The lance according to claim 1, wherein a plurality of the casing pipe grooves and a plurality of the intermediate pipe grooves are provided.

6. The lance according to claim 5, wherein both the plurality of the casing pipe grooves and the plurality of the intermediate pipe grooves are configured to be spiral grooves or straight grooves parallel to an axial direction of the central casing pipe.

7. The lance according to claim 5, wherein the plurality of the casing pipe grooves is uniformly arranged in a surface of a rear part of the central casing pipe, and the plurality of the intermediate pipe grooves is uniformly arranged in a surface of the rear part of the intermediate pipe.

8. The lance according to claim 1, wherein both the casing pipe groove and the intermediate pipe groove have rectangular or triangular cross sections.

9. The lance according to claim 1, wherein the central pipe, the central casing pipe, the intermediate pipe and the outer casing pipe are configured to be stainless steel pipes.

* * * * *